US007810910B2

(12) United States Patent
Ciminelli et al.

(10) Patent No.: US 7,810,910 B2
(45) Date of Patent: Oct. 12, 2010

(54) FLUID-EJECTING DEVICE WITH SIMPLIFIED CONNECTIVITY

(75) Inventors: Mario J. Ciminelli, Rochester, NY (US); David M. Orlicki, Rochester, NY (US); Christopher R. Morton, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 1066 days.

(21) Appl. No.: 11/427,374

(22) Filed: Jun. 29, 2006

(65) Prior Publication Data

US 2008/0001999 A1 Jan. 3, 2008

(51) Int. Cl.
*B41J 2/05* (2006.01)

(52) U.S. Cl. ..... 347/58; 347/59; 347/50; 347/49; 347/12

(58) Field of Classification Search ..... 347/50, 347/58, 59, 49, 12
See application file for complete search history.

(56) References Cited

U.S. PATENT DOCUMENTS

| | | | | |
|---|---|---|---|---|
| 4,791,440 | A * | 12/1988 | Eldridge et al. | 347/58 |
| 6,027,208 | A * | 2/2000 | Amano | 347/70 |
| 6,053,598 | A * | 4/2000 | Inpyn | 347/49 |
| 6,241,340 | B1 | 6/2001 | Watanabe et al. | 347/50 |
| 6,659,591 | B2 | 12/2003 | Sato et al. | 347/50 |
| 6,843,552 | B2 | 1/2005 | McElfresh et al. | 347/50 |
| 7,469,993 | B2 * | 12/2008 | Murata et al. | 347/50 |
| 2003/0202047 | A1 * | 10/2003 | McElfresh et al. | 347/50 |
| 2004/0095437 | A1 | 5/2004 | Kim et al. | |
| 2005/0156980 | A1 | 7/2005 | Walker | |
| 2006/0044363 | A1 * | 3/2006 | Katayama | 347/71 |

FOREIGN PATENT DOCUMENTS

| | | |
|---|---|---|
| EP | 1 199 169 | 4/2002 |

* cited by examiner

*Primary Examiner*—Matthew Luu
*Assistant Examiner*—Henok Legesse
(74) *Attorney, Agent, or Firm*—Robert L. Walker; Peyton C. Watkins

(57) ABSTRACT

A fluid-ejecting device with simplified connectivity is disclosed herein. According to an embodiment of the present invention, a common lead is provided such that a plurality of electrical contacts on a fluid-ejecting chip are connected to the common lead, which is located on a single-layer-flex circuit. Because a common lead is provided at an edge of the single-layer-flex circuit adjacent the fluid-ejecting chip, fewer signals need to be routed through the single-layer-flex circuit to such edge, thereby reducing the complexity of such circuit. Further, bond sites at the edge of the single-layer-flex circuit adjacent the fluid-ejecting device are arranged in a manner that minimizes the required length of wire bonds for connecting such contacts to the contacts on the fluid-ejecting chip.

18 Claims, 8 Drawing Sheets

FLUID-EJECTING DEVICE WITH SIMPLIFIED CONNECTIVITY

FIELD OF THE INVENTION

This invention relates to fluid-ejecting devices. In particular, the present invention pertains to fluid-ejecting devices, such as ink jet printing devices, with simplified connectivity.

BACKGROUND OF THE INVENTION

FIG. 1 illustrates a conventional ink jet print head 101. The print head 101 includes an ink reservoir (not shown) which provides ink to a plurality of nozzles 107 arranged in a plurality of rows on fluid-ejecting chips 110. In order to print an image with the print head 101, electrical signals are transmitted to the print head 101 that selectively provide electrical current to particular nozzles 107 causing such nozzles to heat up and eject ink at appropriate points in time to create an image on a substrate. Such electrical signals are provided to the nozzles 107 from a driving circuit (not shown) to contacts 195 located on a printed-circuit ("PC") board 151. The contacts 195 are conductively connected to contacts 190 located on a single-layer-flex circuit 150. The contacts 190 are, in turn, conductively connected to contacts 180 (shown in FIG. 2) located on the single-layer-flex circuit 150 underneath a protective barrier 105. The contacts 180 underneath barrier 105 are disposed adjacent to the fluid-ejecting chips 110 located in a window 152 in the single-layer-flex circuit 150. The contacts 180 are conductively connected to contacts 120 (shown in FIG. 2), which are located on the respective fluid-ejecting chips 110 under the protective barrier 105. The connections between the contacts 180 and the contacts 120 typically occur by the formation of wire bonds (shown in FIG. 2) between such contacts 180, 120. The contacts 120 are conductively connected to the nozzles 107 on the corresponding fluid-ejecting chips 110, thereby allowing the electrical signals to be provided to the nozzles 107 from the driving circuit (not shown).

FIG. 2 illustrates a close-up view of the contacts 180 and the contacts 120, which are concealed in FIG. 1 by the protective barrier 105. For purposes of illustration, however, the protective barrier 105 is absent from FIG. 2. In the conventional print head 101, the contacts 180 and the contacts 120 are respectively arranged in parallel lines such that each contact 180 corresponds to a contact 120 located on a fluid-ejecting chip 110. Each corresponding pair of contacts 180 and 120 are connected via a wire bond 30. (It should be noted that, although wire bonds exist between the contacts above and below the chip 110, they are left out of FIG. 2 for purposes of clarity.)

The conventional print heads use a one-to-one, parallel, relationship between contacts 180 and contacts 120 in order to minimize the length of the wire bonds 30. Because the wire bonds 30 are fragile, they are frequently the source of failure. Accordingly, it is beneficial to keep the length of the wire bonds 30 as short as possible.

However, such a one-to-one relationship between contacts 180 and contacts 120 results in a large number of interconnections. Accordingly, returning to FIG. 1, the number of contacts 190 is large in order to properly route all of the signals that need to be provided to the contacts 180 and, consequently, to the contacts 120. Because the number of interconnections and the complexity of the wiring on the single-layer-flex circuit 150 contributes significantly to the cost of manufacturing the print head 101, it is desirable to simplify the interconnections between the contacts 190, 180, and 120.

SUMMARY OF THE INVENTION

The above-described problems are addressed and a technical solution is achieved in the art by a fluid-ejecting device with simplified connectivity according to the present invention. According to an embodiment of the present invention, a fluid-ejecting device is provided that includes one or more fluid-ejecting chips, each including a plurality of first electrical contacts. Also included is a single-layer-flex circuit having a plurality of second electrical contacts connected to the plurality of first electrical contacts. One of the second electrical contacts is a common lead, thereby allowing a plurality of third electrical contacts located remote from the fluid-ejecting chip(s) on the single-layer-flex circuit to be fewer in number than the first electrical contacts. In other words, by providing a common lead as one of the contacts on the single-layer-flex circuit adjacent the fluid-ejecting chip(s), the number of contacts needed at an edge (or a remote location) on the single-layer-flex circuit is reduced over conventional fluid-ejecting devices.

According to another embodiment of the present invention, more than one common lead is provided as part of the second electrical contacts. Additionally, according to a further embodiment of the present invention, bond sites extend towards the fluid-ejecting chip(s) from the common leads in order to reduce the distance required to connect a wire bond from the common leads to the first electrical contacts.

In addition to the embodiments described above, further embodiments will become apparent by reference to the drawings and by study of the following detailed description.

BRIEF DESCRIPTION OF THE DRAWINGS

The present invention will be more readily understood from the detailed description of exemplary embodiments presented below considered in conjunction with the attached drawings, of which.

It is to be understood that the attached drawings are purposes of illustrating the concepts of the invention and may not be to scale.

DETAILED DESCRIPTION

The present invention reduces the complexity of connecting a fluid-ejecting chip to a single-layer-flex circuit by providing at least one common lead to which more than one electrical contact on a fluid-ejecting chip connects. Accordingly, because the common lead(s) on the single-layer-flex circuit adjacent the fluid-ejecting chip act(s) as a single electrical contact for a plurality of contacts on the fluid-ejecting chip, fewer signals need to be routed to the contacts on the edge of the single-layer-flex circuit adjacent the fluid-ejecting chip. Such fewer signals reduces the size and the complexity of the circuit, thereby reducing the cost of producing the overall fluid-ejecting device 101.

Additionally, the present invention provides an arrangement of electrical contacts on the single-layer-flex circuit adjacent the fluid-ejecting chip that minimizes the length of the associated wire bonds. Such an arrangement further reduces the complexity of a fluid-ejecting device and increases its reliability.

Figure 1:
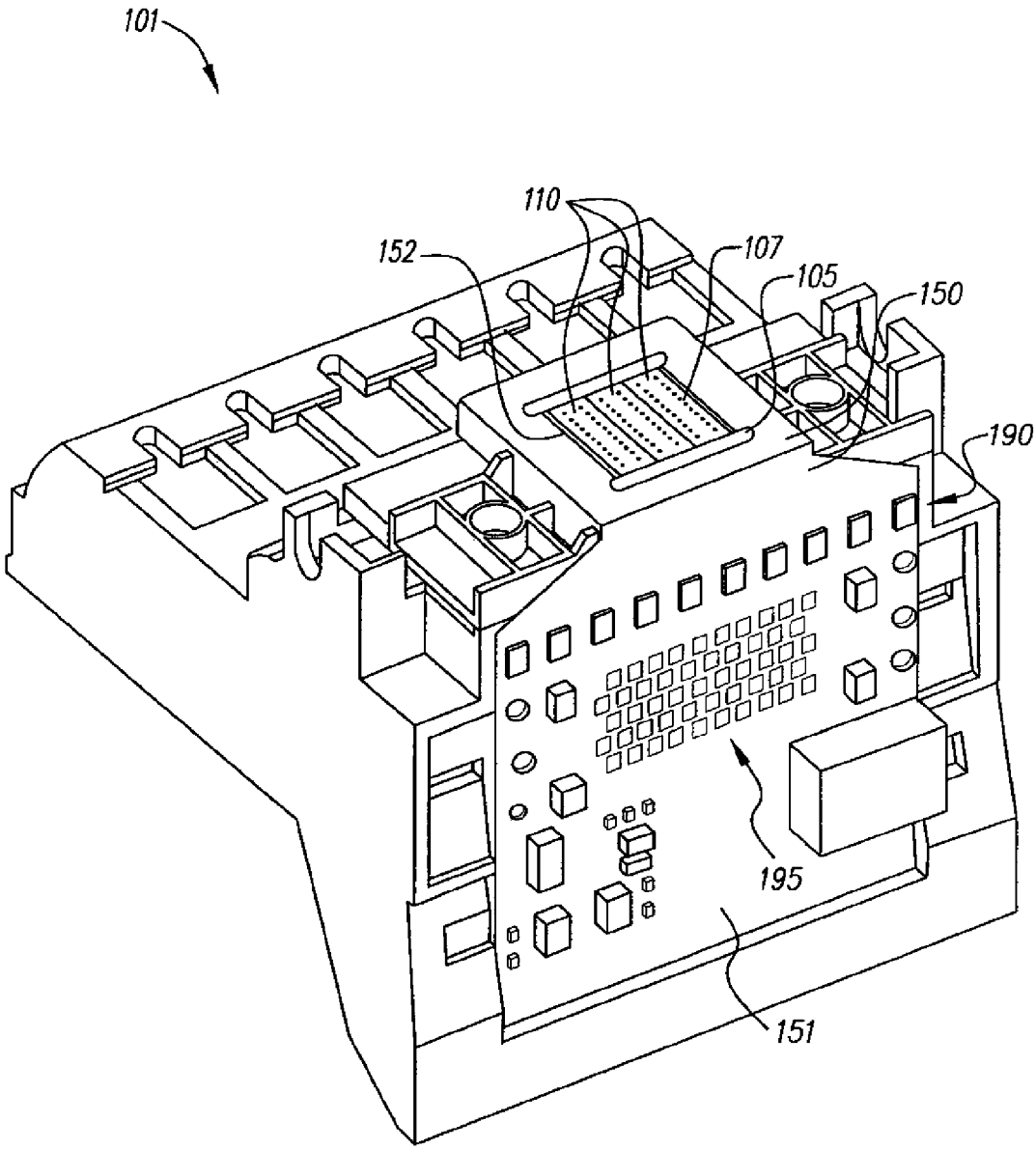
FIG. 1 (PRIOR ART)
FIG. 1 illustrates a conventional fluid-ejecting device.
Figure 2:
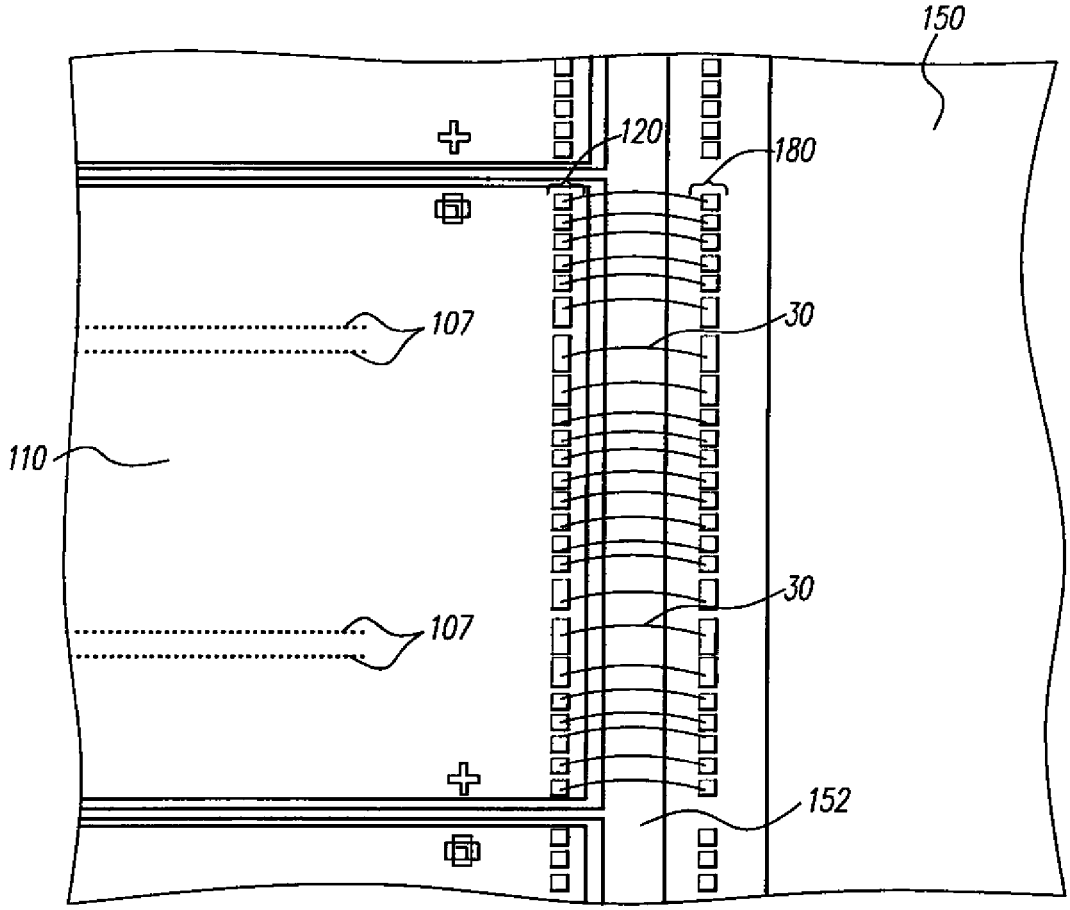
FIG. 2 (PRIOR ART)
FIG. 2 illustrates a close-up view of a conventional fluid-ejecting device.
Figure 3:
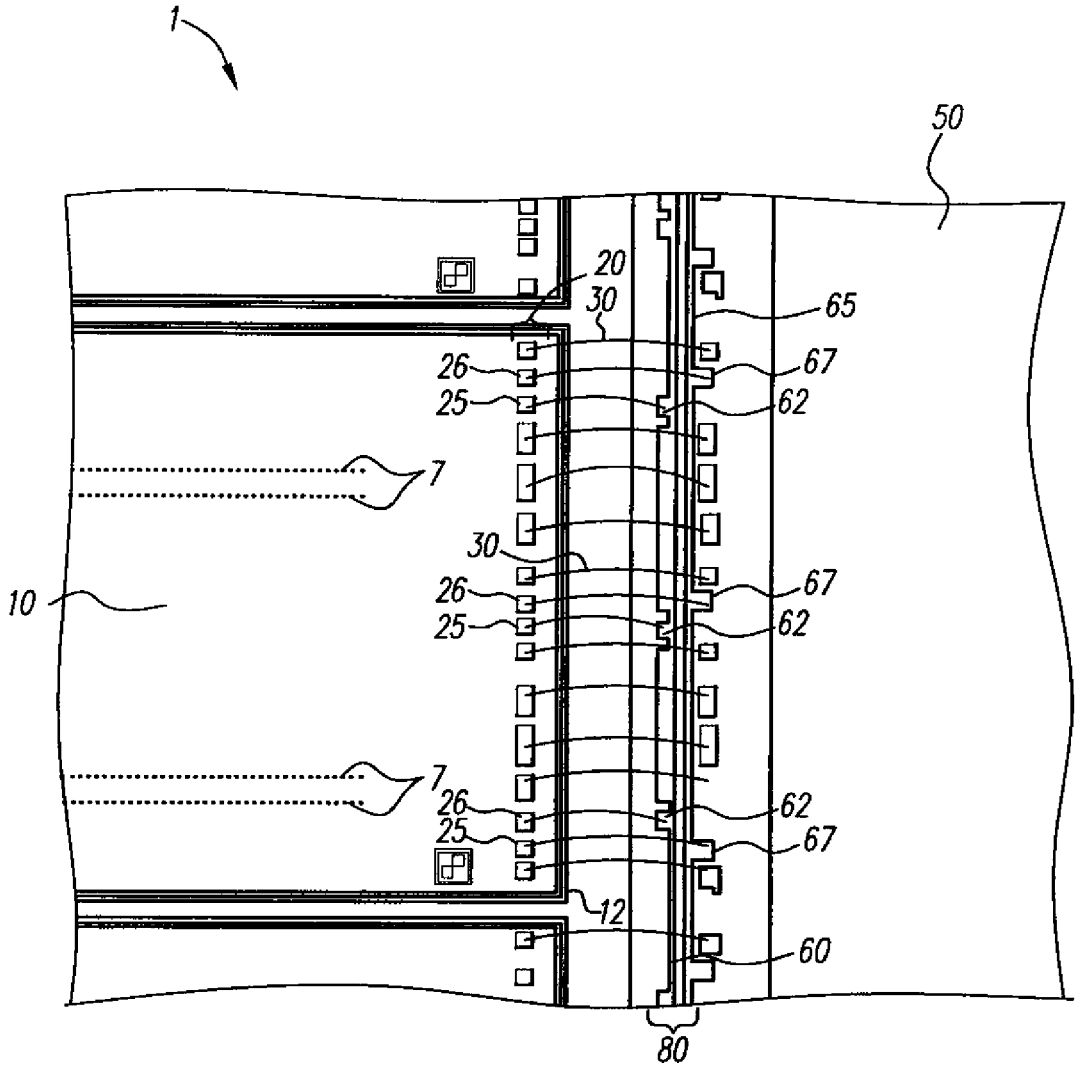
FIG. 3 illustrates a simplified connection arrangement between a fluid-ejecting chip and contacts on a single-layer-flex circuit, according to an embodiment of the present invention.

Turning now to FIG. 3, a simplified connection scheme for a fluid-ejecting device 1, according to an embodiment of the present invention, will now be described. In particular, FIG. 3 illustrates a close-up of a fluid-ejecting chip 10 and an adjacent portion of a single-layer-flex circuit 50. As with conventional fluid-ejecting devices, the fluid-ejecting chips include a plurality of nozzles 7 arranged in one or more lines. However, the present invention is not limited to such an arrangement of nozzles.

At a first edge 12 of the fluid-ejecting chip 10 are a plurality of first electrical contacts 20 disposed in a row. Again, one skilled in the art will appreciate that the invention is not limited to an in-line arrangement of first electrical contacts 20. However, such an arrangement does provide the benefit of reducing the length of wire bonds 30 needed to connect the contacts 20 to a plurality of second electrical contacts 80 disposed at an edge of the single-layer-flex circuit 50 adjacent the chip 10. (It should be noted that, although wire bonds exist between the contacts corresponding to the chips which are above and below the chip 10, they are left out of FIG. 3 for purposes of clarity.)

The plurality of second electrical contacts 80 include a first common lead 60 and a second common lead 65. Although the embodiment of FIG. 3 shows two common leads 60, 65, one skilled in the art will appreciate that a single common lead or more than two common leads may be provided. The first common lead 60 includes a plurality of bond sites 62, each of which is connected via a wire bond 30 to a first electrical contact 25. According to this embodiment, the first electrical contacts 25 are non-adjacent, i.e., not next to each other on the same fluid-ejecting chip 10. For example, two first electrical contacts 20 each located on a separate chip 10, but having no other electrical contact located between them, are considered non-adjacent because they are located on different chips 10.

The bond sites 62, according to an embodiment of the present invention, protrude toward the fluid-ejecting chip 10 in order to minimize the length of the wire bond 30. However, one skilled in the art will appreciate that the bond sites 62 need not extend toward the fluid-ejecting chip 10 nor extend at all. In particular, the bond sites 62 could be indistinguishable from any other portion of the first common lead 60, except that a wire bond is bonded to that particular location of the common lead 60. In other words, the first common lead 60 could be a straight line with no protrusions. Bond sites 62 on such a common lead would be defined as the regions on the common lead where the wire bonds 30 are connected.

Similar to the first common lead 60, the second common lead 65 includes a plurality of bond sites 67. The bond sites 67 are connected to corresponding contacts 26 of the first contacts 20 that are non-adjacent to each other. In the case of the second common lead 65, however, the wire bonds 30 arch over, without touching, the first common lead 60 on their way to the corresponding first electrical contacts 26.

According to an embodiment of the present invention, the first common lead 60 and the second common lead 65 provide power and ground, respectively, or vice versa, to the fluid-ejecting chip 10. Other second electrical contacts 80 may provide, for example, data or clock signals to control the firing of nozzles 7 of the fluid-ejecting chip 10.

Figure 4:
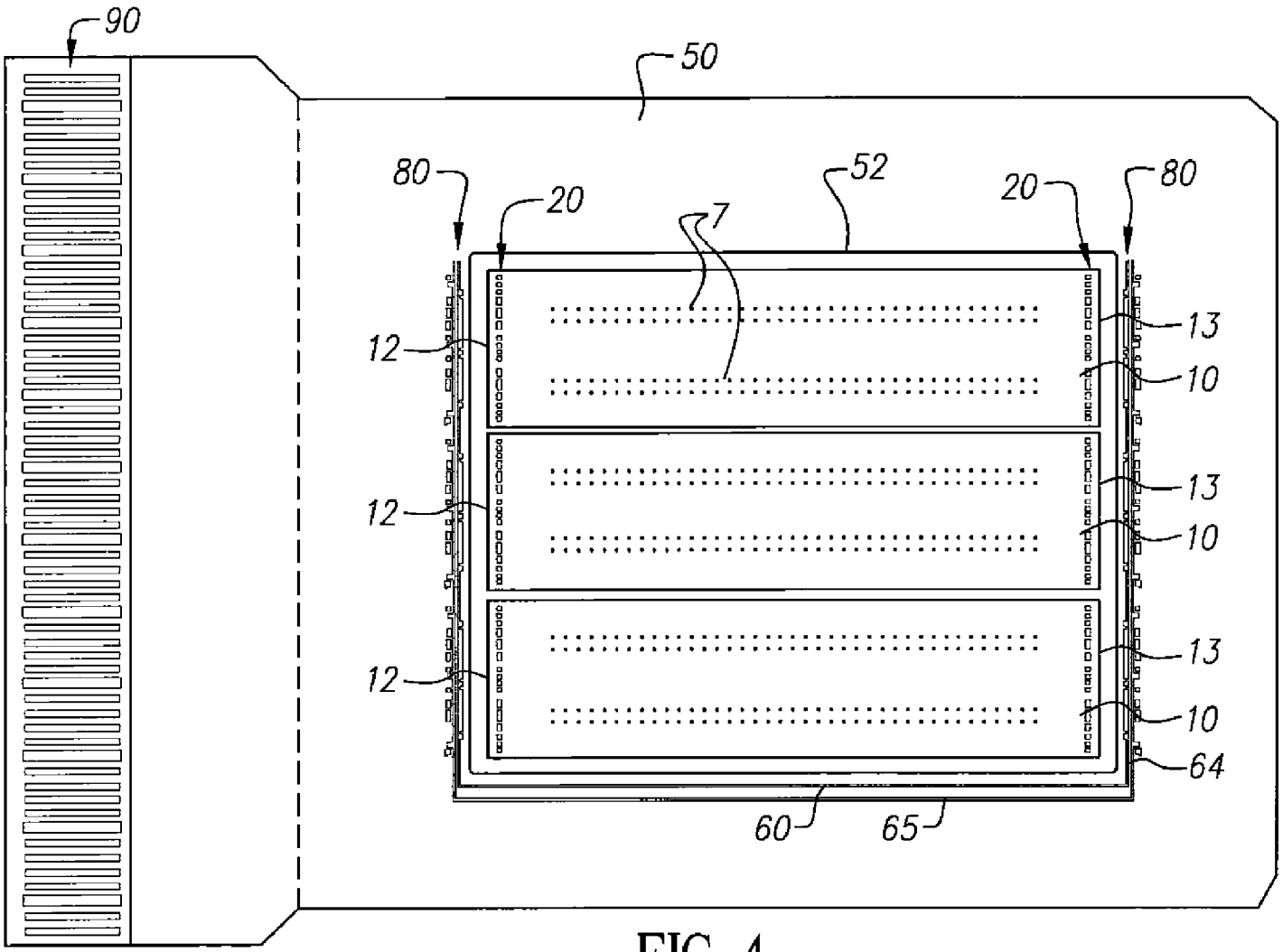
FIG. 4 illustrates an enlarged view of a simplified connection arrangement, according to another embodiment of the present invention.

FIG. 4 illustrates a reduced-magnification view of that illustrated in FIG. 3. In particular, FIG. 4 illustrates the plurality of first electrical contacts 20, the plurality of second electrical contacts 80, and a plurality of fluid-ejecting chips 10. The fluid-ejecting chips 10 are located, according to this embodiment of the present invention, within a window 52 in the single-layer-flex circuit 50. Although the embodiment of FIG. 4 illustrates a single window in which three fluid-ejecting chips 10 are located, one skilled in the art will appreciate that more than one window 52 may be present, and each window may include therein one or more fluid-ejecting chips 10.

The embodiment illustrated in FIG. 4 shows that the connection scheme of FIG. 3 may be applied on a plurality-of-chip 10 basis. In particular, the first electrical contacts 20 are disposed in a line along a first edge 12 of each of the three fluid-ejecting chips 10. The second electrical contacts 80, including the first common lead 60 and second common lead 65, are disposed along an edge of the single-layer-flex circuit 50 adjacent the first edge 12 of the fluid-ejecting chips 10. The second electrical contacts 80 are connected via connections (not shown) to the third electrical contacts 90 disposed at a location remote from the fluid-ejecting chips 10 on the single-layer-flex circuit 50.

The embodiment of FIG. 4 also illustrates that the common leads may extend around the fluid-ejecting chips 10 to provide connections at a second edge 13 of each of the fluid-ejecting chips 10. For example, the first common lead 60 may have an extension 64 that runs parallel to one or more second edges 13 of the fluid-ejecting chips 10.

Figure 5:
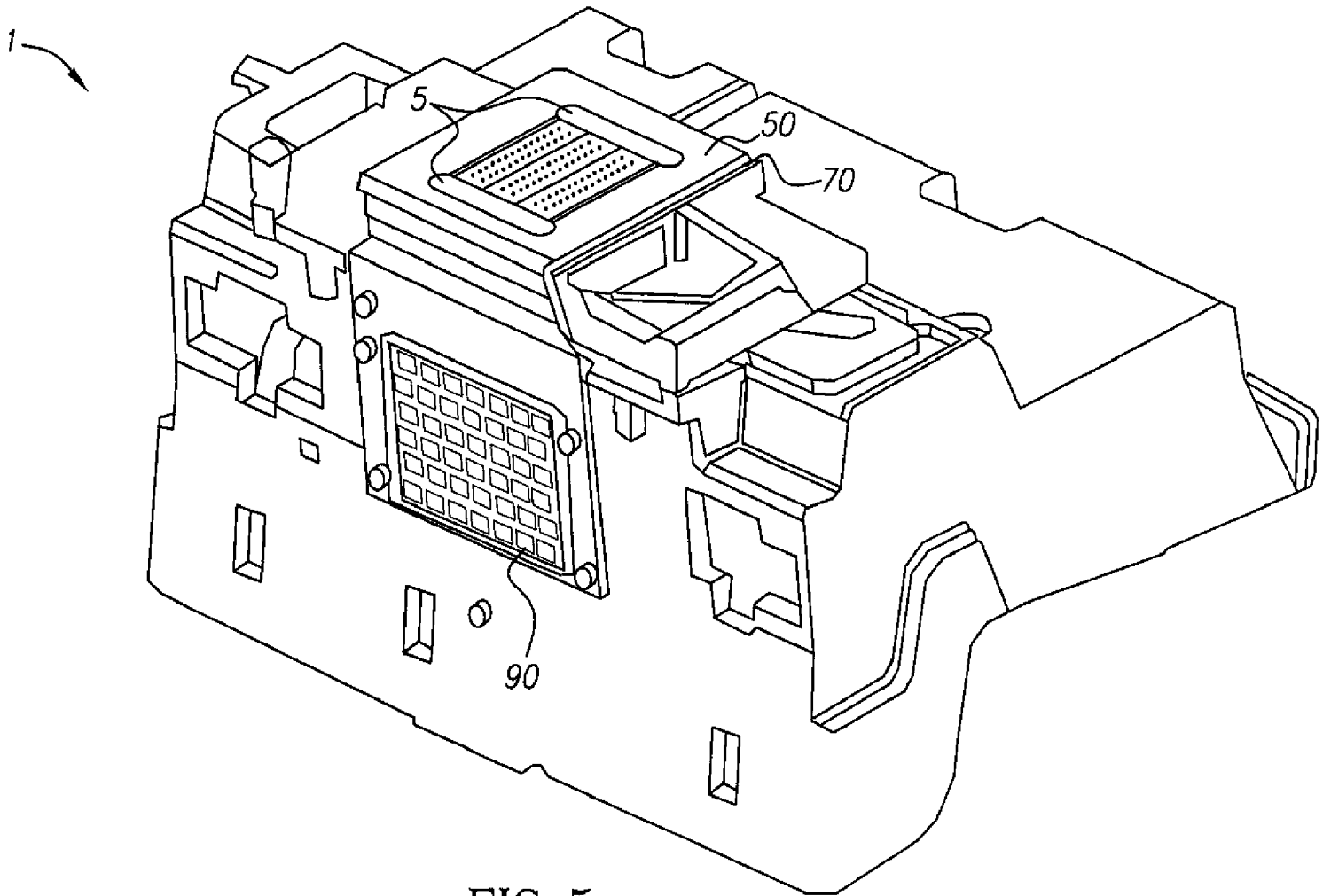
FIG. 5 illustrates a device-level illustration of a fluid-ejecting device with simplified connectivity, according to an embodiment of the present invention.

FIG. 5 illustrates a perspective view of a fluid-ejecting device with simplified connectivity, according to an embodiment of the present invention. In particular, the single-layer-flex circuit 50 wraps around a frame 70 on which it is mounted, such that the third electrical contacts 90 are disposed in a plane at an angle from a plane in which the second electrical contacts 80 (under protective barrier 5) reside. Further, this embodiment illustrates that the third electrical contacts 90 may be disposed in a two-dimensional array and configured to be connected to a driving circuit (not shown). The connection to the driving circuit (not shown) is disconnectable such that the device 1 illustrated in FIG. 5 readily may be disconnected from such driving circuit.

Figure 6:
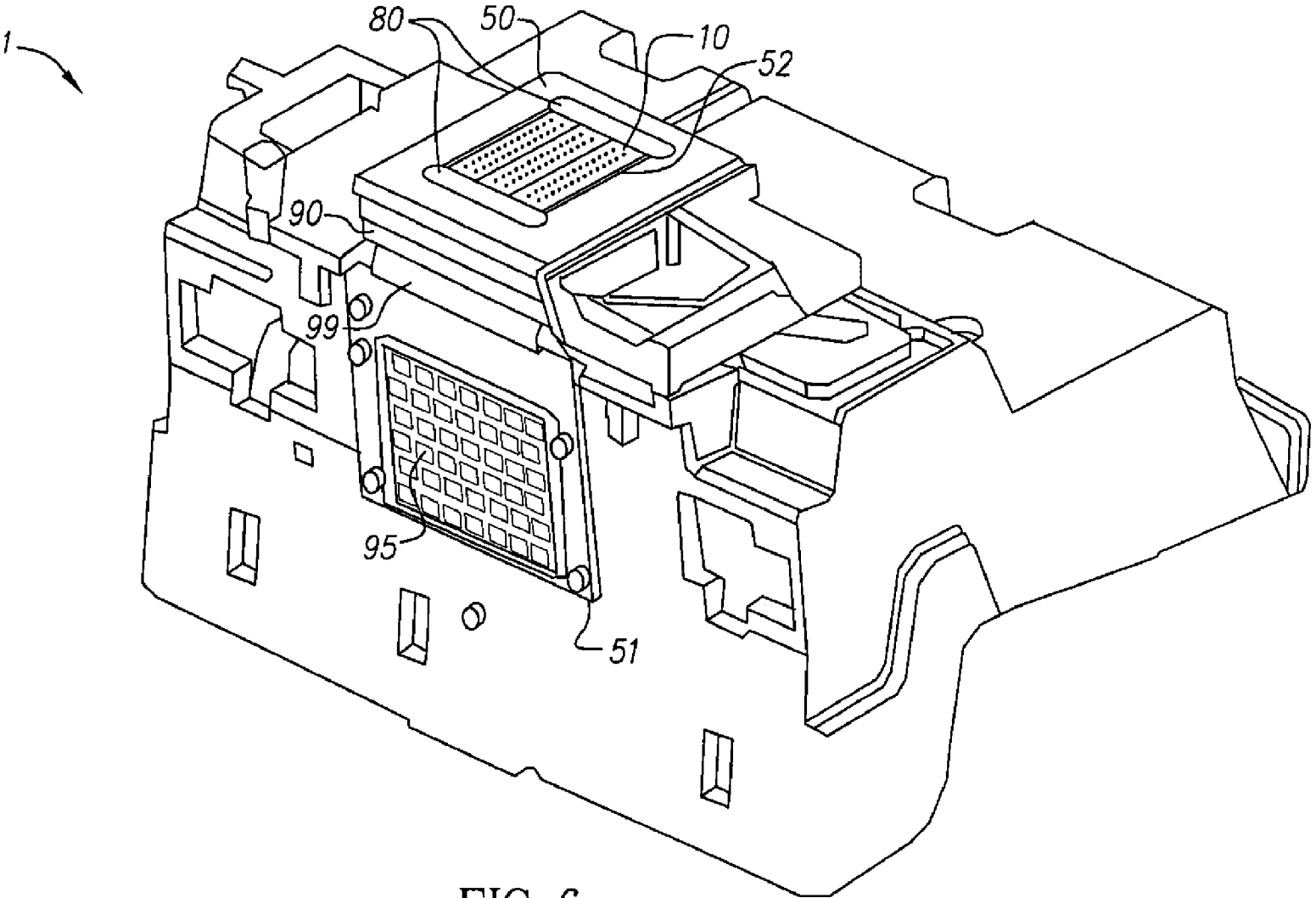
FIG. 6 illustrates a second fluid-ejecting device with simplified connectivity, according to an embodiment of the present invention.

FIG. 6 illustrates a perspective view of a fluid-ejecting device 1, according to yet another embodiment of the present invention. This embodiment deviates from the previous embodiment in that the plurality of fourth electrical contacts 95 are disposed on a PC board 51 separate from the single-layer-flex circuit 50. To accomplish a connection between the single-layer-flex circuit 50 and the PC board 51 on which the fourth electrical contacts 95 are disposed, a plurality of fifth electrical contacts 99 are provided at an edge of the PC board 51 and are conductively connected to the third electrical contacts 90. In this embodiment, the fourth electrical contacts 95 are connectible, in a disconnectable manner, to an external driving circuit (not shown).

Figure 7:
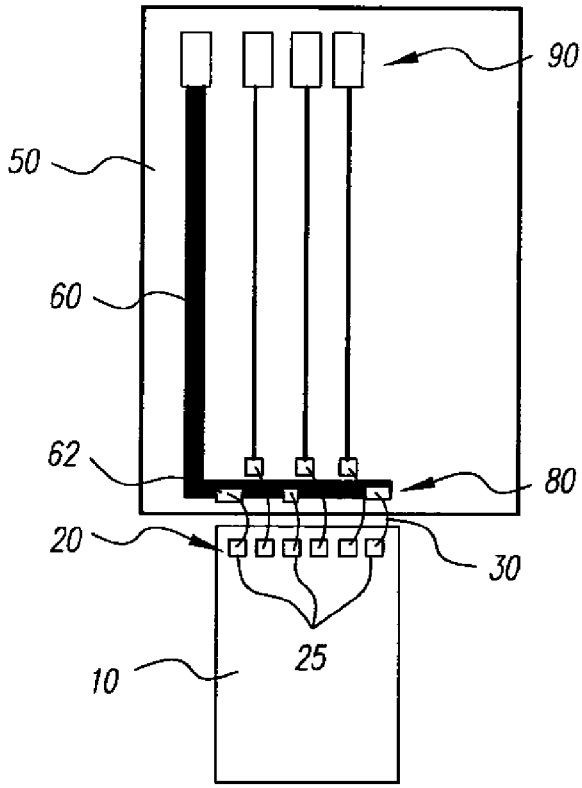
FIGS. 7-10 illustrate example connections between one or more fluid-ejecting chips and single-layer-flex circuits, according to various embodiments of the present invention.

FIG. 7 illustrates a simplified connection scheme according to an embodiment of the present invention. Like reference numerals have been used to indicate like components. In FIG.

7, let "m" equal the sum of all of the first electrical contacts 20. In the example of FIG. 7, m=6. Let "n" equal the total number of third electrical contacts 90. In this example, n=4. As can be seen in FIG. 7, it has been determined that:

$$m>n$$

due to the inventive connection scheme.

Further, let "$p_1$" (reference numeral 25) equal the number of non-adjacent first electrical contacts electrically connected to corresponding bond sites on the first common lead 60. In this case, $p_1=3$. As illustrated in FIG. 7, it has been determined that:

$$(m-n)>=(p_1-1)$$

due to the inventive connection scheme.

Figure 8:
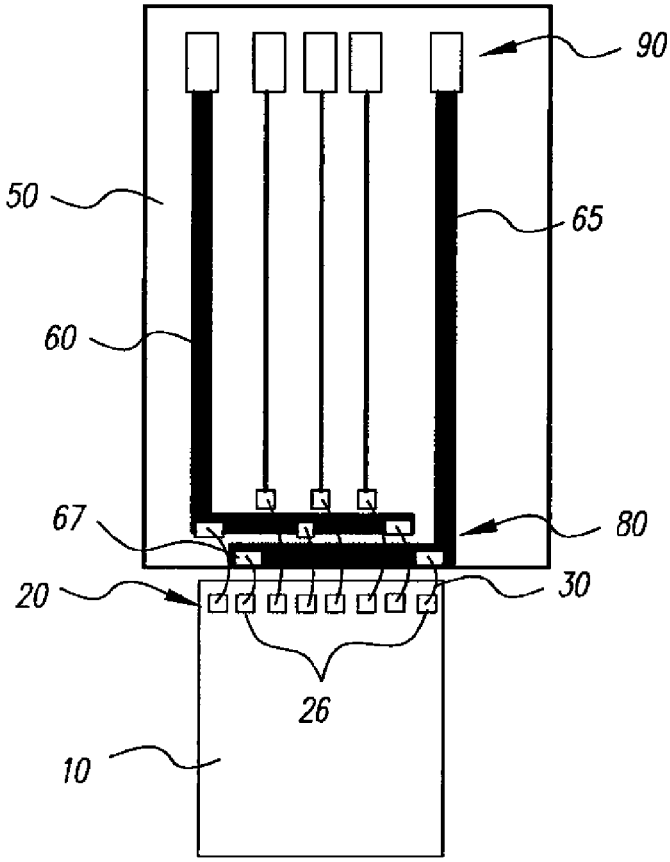

Turning now to FIG. 8, an embodiment having two common leads is illustrated. In this example, let "$q_1$" (reference numeral 26) be the number of non-adjacent first electrical contacts 20 electrically connected to corresponding bond sites on the second common lead 65. In this case $q_1=2$. As illustrated in this example, it has been determined that:

$$(m-n)>=(p_1+q_1-2)$$

due to the inventive connection scheme.

Figure 9:
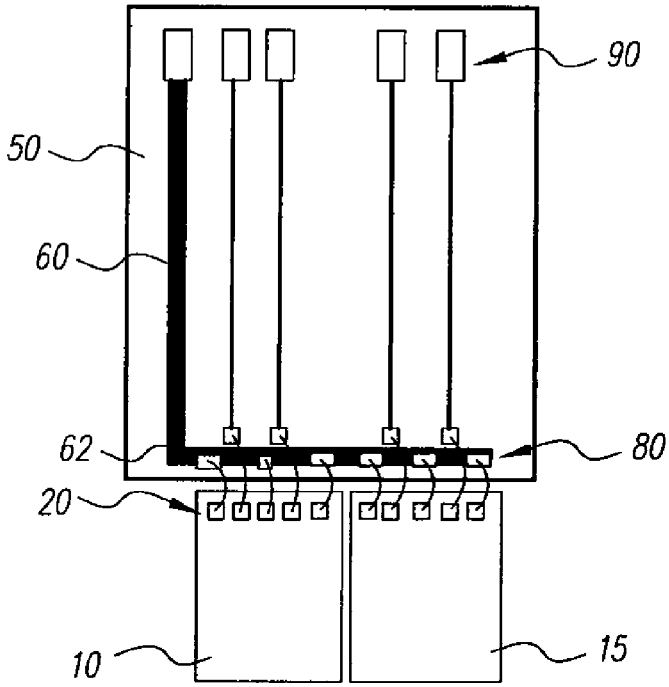

Turning now to FIG. 9, a single common lead with two fluid-ejecting chips 10, 15 are illustrated. In this example, let m equal the sum of all first electrical contacts 20 regardless of which chip 10, 15 they are located. More specifically, let $m_1$ equal the number of first electrical contacts 20 on the chip 10 and $m_2$ equal the number of first electrical contacts 20 on the chip 15. In this case, $m=_1+m_2$, which is 10 in the example of FIG. 9. Further, let $p_1$ equal the number of non-adjacent first electrical contacts on the first fluid-ejecting chip 10, and $p_2$ equal the number of non-adjacent first electrical contacts on the second chip 15. As illustrated in FIG. 9, it has been determined that the expression:

$$(m-n)>=(p-1)$$

holds in the case where:

$$m=(m_1+m_2) \text{ and } p=(p_1+p_2).$$

Consequently, $$(m-n)>=(p_1+p_2-1)$$

Figure 10:
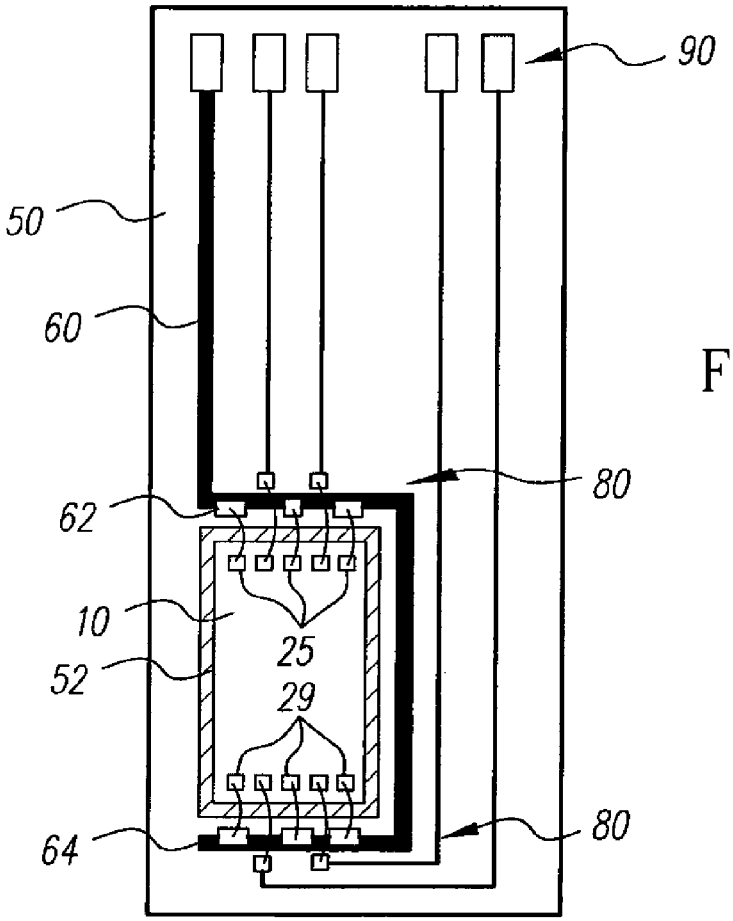

FIG. 10 illustrates an embodiment having first electrical contacts on a first edge of the fluid-ejecting chip 10 and first electrical contacts on a second edge of the chip 10. The first electrical contacts on the first edge of the chip 10 are referred to by reference numeral 25, whereas the first electrical contacts on the second edge of the chip 10 are referred to with reference numeral 29. m, as always, refers to the total number of first electrical contacts, which in this case is 10. p, again, equals the sum of all non-adjacent first electrical contacts connected to the first common lead. In this case, p equals the sum of the non-adjacent first electrical contacts on the first edge of the chip 10 (represented as $p_1$, reference numeral 25) and the non-adjacent first electrical contacts on the second edge of the chip 10 (represented as $r_1$, reference numeral 29). In this example, $$p=(p_1+r_1)=6.$$

It has been determined, as illustrated in FIG. 10, that the expression:

$$(m-n)>=(p-1)$$

holds even for connections on different sides of the fluid-ejecting chip 10. Consequently, $$(m-n)>=(p_1+r_1-1)$$

It is to be understood that the exemplary embodiments are merely illustrative of the present invention and that many variations and/or combinations of the above-described embodiments can be devised by one skilled in the art without departing from the scope of the invention. For example, although the present invention is sometimes described in the context of ink jet print heads, one skilled in the art will appreciate that the present invention applies to any other type of fluid-ejection device having the same or similar interconnection issues. It is therefore intended that all such variations and combinations be included within the scope of the following claims and their equivalents.

PARTS LIST m total number of first electrical contacts
p sum of the non-adjacent first electrical contacts
S fluid-ejecting chip
1 fluid-ejecting device
5 protective barrier
7 nozzles
10 fluid-ejecting chip
12 first edge
13 second edge
15 fluid-ejecting chip
20 first electrical contacts
25 first electrical contact
26 first electrical contact
29 first electrical contacts on the second edge of the chip 10
30 wire bonds
50 single-layer-flex circuit
51 PC board
52 window
60 first common lead
62 bond sites
64 extension of the first common lead
65 common lead
67 bond sites
70 frame
80 second electrical contacts
90 third electrical contacts
95 fourth electrical contacts
99 fifth electrical contacts
101 printing device
105 protective barrier
107 nozzles
110 fluid-ejecting chips
120 electrical contacts
150 single-layer-flex circuit
151 PC board
152 window
180 electrical contacts
190 electrical contacts
195 electrical contacts

What is claimed is:

1. A fluid-ejecting device comprising:

one or more fluid-ejecting chips each comprising a plurality of first electrical contacts, the sum of the first contacts being equal to m; and a single-layer-flex circuit comprising a plurality of second electrical contacts connected to the plurality m of first electrical contacts;

wherein one of the second contacts comprises a first common lead, and a plurality of nonadjacent contacts of the plurality of first electrical contacts are conductively connected to corresponding bond sites on the first common lead; and wherein the single-layer-flex circuit further comprises a plurality of n third electrical contacts that are directly connected to the plurality of second electrical contacts; and wherein m>n.

2. The fluid-ejecting device of claim 1, wherein the plurality of n third electrical contacts are disposed in or on a region of the single-layer-flex circuit that is remote from the fluid-ejecting chip(s).

3. The fluid-ejecting device of claim 1, wherein the third electrical contacts are disposed in or on the single-layer-flex circuit in a two-dimensional array.

4. The fluid-ejecting device of claim 1, wherein the plurality of second electrical contacts are disposed in a first plane, and the plurality of third electrical contacts are disposed in a second plane, wherein the first plane is disposed at an angle from the second plane.

5. The fluid-ejecting device of claim 1, wherein one of the second electrical contacts comprises a first common lead, at least a first portion of which is (a) parallel or substantially parallel to a first edge of the fluid-ejecting chip, if one fluid-ejecting chip is present.

6. The fluid-ejecting device of claim 1, further comprising a wire bond between a first electrical contact and a second electrical contact.

7. The fluid-ejecting device of claim 1, further comprising a PC board, wherein the third electrical contacts are connected to a set of contacts disposed on the PC board.

8. The fluid-ejecting device of claim 5, wherein (m−n) is greater than or equal to $(p_1-1)$; wherein $p_1$ is a plurality of non-adjacent electrical contacts of the plurality of first electrical contacts.

9. The fluid-ejecting device of claim 5, further comprising a wire bond between one of the first electrical contacts and one of the second electrical contacts, wherein an arch in the wire bond crosses over the first common lead without touching the first common lead.

10. The fluid-ejecting device of claim 5, wherein the single-layer-flex circuit further comprises a second common lead, at least a portion of which is (a) parallel or substantially parallel to the first edge of the fluid-ejecting chip, if one fluid-ejecting chip is present, or (b) parallel or substantially parallel to the first edge of one of the fluid-ejecting chips, if a plurality of fluid-ejecting chips are present, the second common lead comprising a plurality of bond sites, wherein a plurality of $q_1$ nonadjacent electrical contacts of the plurality of first electrical contacts are conductively connected to corresponding bond sites on the second common lead.

11. The fluid-ejecting device of claim 5, wherein the fluid-ejecting chips comprise a first fluid-ejecting chip and a second fluid-ejecting chip, wherein the second fluid-ejecting chip comprises a plurality of first electrical contacts that are disposed along a first edge of the second fluid-ejecting chip, wherein a second portion of the first common lead is substantially parallel to the first edge of the second chip, wherein the second portion of the first common lead comprises a plurality of bond sites, and wherein a plurality $p_2$ of nonadjacent first electrical contacts on the second chip are conductively connected to corresponding bond sites on the second portion of the first common lead.

12. The fluid-ejecting device of claim 5, wherein the one or more fluid-ejecting chips comprises a first fluid-ejecting chip, and wherein the single-layer-flex circuit further comprises a window in which the first fluid-ejecting chip is disposed, the first fluid-ejecting chip further comprising a plurality of first electrical contacts disposed along a second edge; the first common lead comprising an extension which is substantially parallel to the second edge of the first fluid-ejecting chip; and a plurality of $r_1$ nonadjacent first electrical contacts on the second edge of the first chip are conductively connected to corresponding bond sites on the extension of the first common lead.

13. The fluid-ejecting device of claim 5, wherein at least one of the bond sites protrudes towards a fluid-ejecting chip.

14. The fluid-ejecting device of claim 5, wherein the bond sites do not protrude from the first common lead.

15. The fluid-ejecting device of claim 10, wherein (m−n) is greater than or equal to $(p_1+q_1-2)$; wherein $p_1$ is a plurality of non-adjacent electrical contacts of the plurality of first electrical contacts.

16. The fluid-ejecting device of claim 11, wherein (m-n) is greater than or equal to $(p_1+p_2-1)$; wherein $p_1$ is a pluarlity of non-adjacent electrical contacts of the plurality of first electrical contacts.

17. The fluid-ejecting device of claim 11, wherein the first edge of the second fluid-ejecting chip is in line or substantially in line with the first edge of the first fluid-ejecting chip.

18. The fluid-ejecting device of claim 12, wherein (m−n) is greater than or equal to $(p_1+r_1-1)$; wherein $p_1$ is a plurality of non-adjacent electrical contacts of the plurality of first electrical contacts.

* * * * *